US005166015A

United States Patent [19]

Ichikawa et al.

[11] Patent Number: 5,166,015

[45] Date of Patent: Nov. 24, 1992

[54] PHOTOGRAPHIC PHOTOSENSITIVE SOLUTION MANUFACTURING METHOD AND APPARATUS

[75] Inventors: Yasunori Ichikawa; Hiroshi Ohnishi; Akira Kojima; Akira Kato, all of Kanagawa, Japan

[73] Assignee: Fuji Photo Film Co., Ltd., Kanagawa, Japan

[21] Appl. No.: 599,251

[22] Filed: Oct. 18, 1990

Related U.S. Application Data

[63] Continuation of Ser. No. 226,909, Aug. 1, 1988, abandoned.

[30] Foreign Application Priority Data

Jul. 30, 1987 [JP] Japan ..... 62-188736

[51] Int. Cl.[5] ..... G03C 1/015

[52] U.S. Cl. ..... 430/30; 430/569

[58] Field of Search ..... 430/567, 569, 30; 423/491, DIG. 5; 222/504; 251/129.05

[56] References Cited

U.S. PATENT DOCUMENTS 3,821,002 6/1974 Culhane et al. .
3,990,048 12/1976 Parthemore .
4,026,668 5/1977 Culhane et al. ..... 417/293
4,147,551 4/1979 Finnicum et al. ..... 430/567
4,157,289 6/1979 Ikenoue et al. ..... 430/564
4,976,404 12/1990 Ichikawa et al. ..... 251/129.05

FOREIGN PATENT DOCUMENTS 0152191 8/1985 European Pat. Off. .
2253751 5/1973 Fed. Rep. of Germany .

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method and apparatus for manufacturing photographic photosensitive solultion to produce crystals of silver halide emulsion having a uniform size and shape and without substantial waste of expensive $Ag^+$ solution. Flow control valves for controlling the flow rates of $Ag^+$ and $X^-$ solutions are controlled according to a predetermined flow rate or pAg potential program and using output signals of respective flow meters or a pAg potentiometer. The flow control valves are motor-controlled flow control valves for which the rate of change of flow rate with valve stroke is small and linear.

5 Claims, 2 Drawing Sheets

PHOTOGRAPHIC PHOTOSENSITIVE SOLUTION MANUFACTURING METHOD AND APPARATUS

This is a continuation of application Ser. No. 07/226,909, filed Aug. 1, 1988, now abandoned.

BACKGROUND OF THE INVENTION

The present invention relates to photographic photosensitive solution manufacturing method and apparatus for practicing such a method. More particularly, the invention relates to a method for mixing $Ag^+$ and $X^-$ solutions to produce crystals of silver halide emulsion in a photographic photosensitive solution manufacturing process, and to an apparatus for practicing such a method.

Examples of a conventional method for adding $Ag^+$ and $X^-$ solutions to produce crystal of silver halide emulsion in a photographic photosensitive solution manufacturing process and a conventional apparatus for practicing such a method include a method and apparatus in which the addition is controlled by means of a pump (see, for instance, U.S. Pat. Nos. 4,147,551 and 4,251,627) and a method and apparatus in which the addition is controlled by means of a control valve (see, for instance, U.S. Pat. Nos. 3,692,283, 3,897,935, 3,999,048, 4,026,668 and 4,031,912).

However, the method in which the addition is controlled by means of a pump suffers from the following difficulties:

(1) In a batch-type process, after addition, some expensive $Ag^+$ solution must be left in the tank and pipes in order to prevent idling of the pump. That is, all the prepared solution cannot be used.

(2) When $Ag^+$ solution is supplied with the pump, Ag will deposit, for instance, on the sealed parts of the pump, thus obstructing the operation of the same.

(3) The pulsation of the pump adversely affects the formation of particles. Therefore, the resultant emulsion particles tend to greatly vary in size and shape.

(4) In the case where various different solutions are to be manufactured on a small scale, requisite cleaning of the apparatus takes a significantly long time.

On the other hand, the method and apparatus in which addition is controlled by means of a control valve is disadvantageous in the following points:

(1) The diaphragm control valve generally used in such a method and apparatus generally has a low flow control accuracy, which causes the resultant emulsion particles to vary widely in size and shape.

(2) To manufacture a variety of different photosensitive solutions, the flow rate must be changed. However, since the relation of the flow rate to the degree of valve opening is not linear, it is difficult to maintain ideal control conditions.

(3) Because the diaphragm control valve is particularly low in flow control accuracy near the fully opened and fully closed positions, the flow control range is limited. Therefore, in order to be able to manufacture a variety of different photosensitive solutions, it is necessary to provide a plurality of diaphragm valves of different sizes. This adversely affects the overall system design, space utilization, and load of control.

SUMMARY OF THE INVENTION

Accordingly, an object of the invention is to eliminate the above-described difficulties. More specifically, an object of the invention is to provide a photographic photosensitive solution manufacturing method and apparatus in which $Ag^+$ and $X^-$ solutions are added together and by which a variety of different photosensitive solutions can be manufactured, the equipment can be easily operated, and flow control valves employed in the apparatus are capable of controlling the addition of $Ag^+$ and $X^-$ in such a manner as to manufacture silver halide emulsion crystals uniform both in size and shape.

The foregoing and other objects of the invention have been achieved by the provision of a photographing photosensitive solution manufacturing method and apparatus in which respective flow control valves for controlling the flow rates of $Ag^+$ and $X^-$ solutions are controlled according to a specified flow rate or pAg potential program and in response to output signals from respective flow meters or pAg potentiometers, and in which, according to the invention, the flow control valves are motor-controlled flow control valves for which the rate of change of flow rate with valve stroke is small and linear.

DESCRIPTION OF THE PREFERRED EMBODIMENTS

Preferred embodiments of the invention will now be described with reference to the accompanying drawings.

Figure 1:
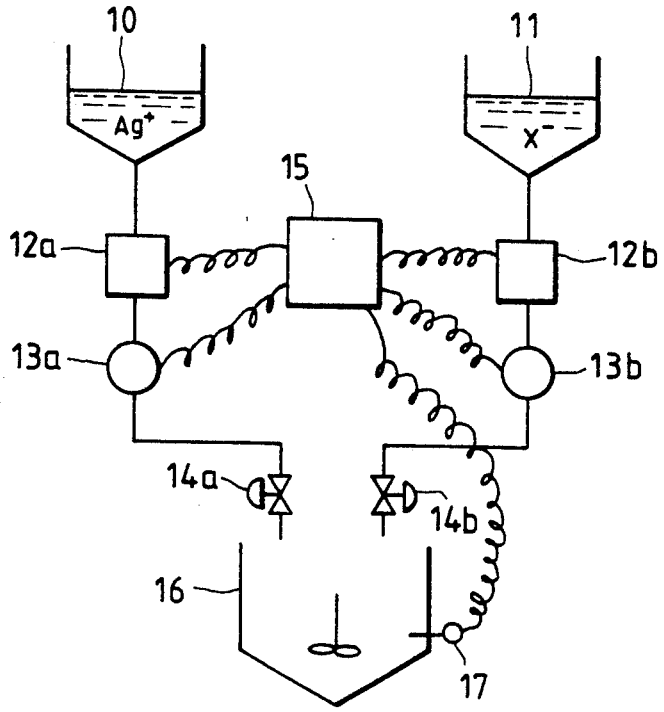
FIG. 1 illustrates schematically a photographic photosensitive solution manufacturing method and apparatus according to the present invention.

FIG. 1 illustrates schematically a photographic photosensitive solution manufacturing method and apparatus according to the present invention. The apparatus includes a raw material storage tank 10 containing $Ag^+$ solution prepared in advance, a raw material storage tank 11 containing an $X^-$ solution also prepared in advance, flow control valves 12*a* and 12*b*, flow meters 13*a* and 13*b*, stop valves 14*a* and 14*b* connected to pipes extending from the respective raw material storage tanks 10 and 11, a precipitation vessel 16 which receives the $Ag^+$ and $X^-$ solutions from the raw material storage tanks 10 and 11 and agitates them for reaction, and a controller 15 which receives feedback signals from the flow meters 13*a* and 13*b* and from a pAg potentiometer 17 mounted in the precipitation vessel 16 and in response controls the flow control valves 12*a* and 12*b* in accordance with a predetermined program.

Figure 2:
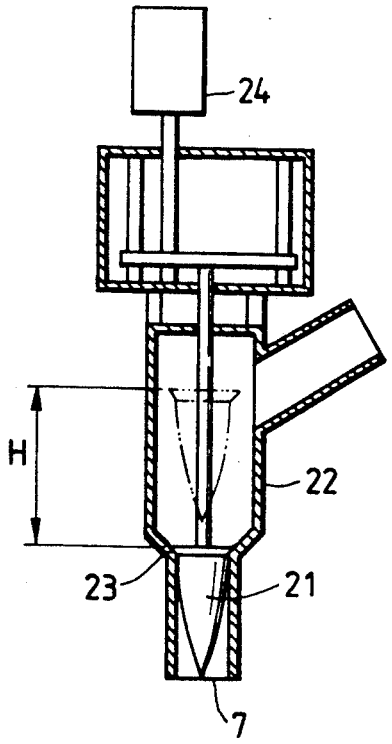
FIG. 2 is a cross-sectional side view of a flow control valve used in the manufacturing method and apparatus illustrated in FIG. 1.
Figure 3A:
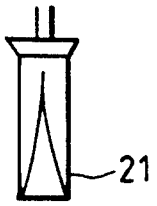
FIGS. 3 (*a*) and 3(*b*) are enlarged front and side views respectively, showing the valve head of the flow control valve of FIG. 2.
Figure 3B:
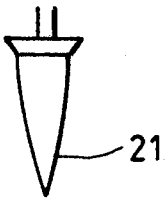

Each of the flow control valves 12*a* and 12*b* is constructed as shown in FIGS. 2, 3(*a*) and 3(*b*). More specifically, each of the flow control valves 12*a* and 12*b* includes a cylindrically or conically elongated valve head 21 in a valve casing 22, the valve head 21 having a stroke H which completely disengages the valve head 21 from its valve seat 23. The valve head 21 is moved by a servo motor 24.

Rotational motion of the motor 24 is transmitted through a feed screw mechanism 23 to a coupling plate 25 so as to move the latter up and down. The coupling plate 25 is connected to the valve shaft 26. Therefore, the valve shaft 26 is moved up and down as the coupling plate is moved up and down. The cylindrically or conically shaped valve head 21 formed on a circular truncated cone which tapers towards the outlet of the valve is positioned on the outlet side of the valve casing.

Figure 4:
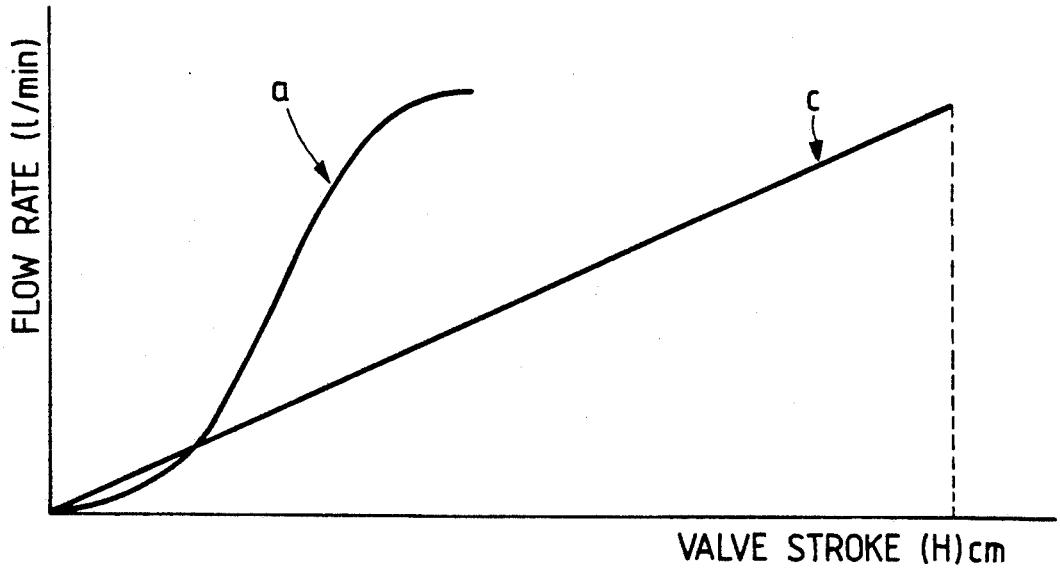
FIG. 4 is a graph showing flow rate with valve stroke and comparing a flow control valve used with the invention with a conventional flow control valve.

As shown by a curve c in FIG. 4, the rate of change of the flow rate with the valve stroke measured between the valve head 21 and the valve seat 23 is small and linear. The opening stroke of the valve takes place in the long inlet side of the valve casing, thus allowing the valve seat 23 to be made large. The valve head 21 is moved by the servo motor 24, as has been previously described.

With the previously prepared $Ag^+$ and $X^-$ solutions filled in their respective storage tanks 10 and 11, the flow control valves 12*a* and 12*b* are controlled according to a specified flow rate program or pAg potential program, for instance, in the form of $Q=at^2+bt+c$ or $E=lt^2+mt+n$, and with the aid of feedback signals from the flow meters 13*a* and 13*b* or the pAg potentiometer 17. In each of the flow control valves 12*a* and 12*b*, as described above, the valve head 21 is lifted by the servo motor 24 (having the valve characteristic curve c in FIG. 4). It should be noted that the flow valve used in the practice of the invention has a flow control range about fifty times as large and has a smaller and more linear rate of change of flow rate with valve stroke compared with conventional valves, characteristics of which are indicated by curves a and b in FIG. 4.

The prepared $Ag^+$ and $X^-$ solutions are held at the respective stop valves 14*a* and 14*b* before the start of addition, while the flow control valves 12*a* and 12*b* are automatically set at positions corresponding to the flow rates at the start of addition as determined by the particular type of solution to be prepared. The flow control valves 12*a* and 12*b* can be accurately automatically set because their rate of change of flow rate with the degree of valve opening is smaller than in the case of other flow valves.

In response to an addition start signal, the stop valves 14*a* and 14*b* are opened, thus starting the addition operation. The flow meters 13*a* and 13*b* feed back measured values to the controller 15. The controller 15 compares the fed-back values with the set values, and controls the flow control valves 12*a* and 12*b* so that the fed-back values are made equal to the set values. Alternately, the controller 15 may receive the pAg potential output signal from the pAg potentiometer 17 and control the flow control valves 12*a* and 12*b* in such a manner that the pAg potential output signal is held equal to the set value.

In the above-described flow control valves, the flow control range from the fully closed position of the valves to the fully opened position is wide since the valve structure produces a very low resistance to the fluid flow, and because the valve stroke is long, the configuration of the valve head allows the flow rate to change linearly with the valve stroke. Therefore, even an extremely small flow change can be precisely controlled. Furthermore, since a servo motor is employed for lifting the valve head, valve control can be achieved easily and quickly. Therefore, the flow control program can be implemented precisely and quickly, and for production of a variety of photographic photosensitive solutions, the silver halide emulsion crystals can be made to have a uniform size and shape.

Specific examples of the invention will now be described.

EXAMPLE 1

To compare a conventional pump-operated addition control method and apparatus with the present invention, comparison tests were carried out with the following prescription:

| | | | |
|---|---|---|---|
| Solution I: | Distilled water | 248 liters | |
| | Gelatin | 6 kg | 50° C. |
| Solution II: | Distilled water | 80 liters | |
| | $AgNO_3$ | 20 kg | 35° C. |
| Solution III: | KBr | 7.7 kg | |
| | KI | 55 g | 35° C. |
| | Distilled Water | 88 liters | |

In the case of the pump-operated addition control method, in order to prevent idling of the pump, solutions I and II were prepared on a scale of 1.2 times the prescribed amounts.

The adding condition was such that solution II was added at a constant flow rate of 2 liters/min and solution III was controlled so that $P_{Ag}$ in the vessel was maintained at 8.8 In the conventional method and apparatus, the addition process was ended at the time when the total addition time for solution II became equal to that in the method and apparatus of the invention.

For controlling the pAg potential and the flow rate, a single-loop controller manufactured by Toshiba Co. was employed to determine the PID value with which the best control conditions could be obtained. The control conditions thus obtained were applied to all solutions. The pump used in the tests was a gear pump manufactured by Marg Co. The same agitating conditions were applied to all solutions.

The results of the tests were as follows:

| | $P_{Ag}$ variation range |
|---|---|
| Invention: | 8.8 ± 0.05 or less |
| Prior Art: | 8.8 ± 0.07 |

(2) After the addition process was completed, the particle size and distribution were measured after aging had been carried out for a predetermined period of time:

| | Av. Particle Size | Standard Deviation |
|---|---|---|
| Invention: | 1.14 μm | 0.15 μm |
| Prior Art: | 1.13 μm | 0.25 μm |

EXAMPLE 2

The same solutions as in Example I were used to compare diaphragm type control valves with the flow control valves of the invention.

With the flow rate of solution II set to 2 liters/min and the control pAg potential $P_{Ag}=8.8$, the addition of solution III was controlled.

For the control of the pAg potential and flow rate, the aforementioned single-loop controller manufactured by Toshiba Co. was employed. Diaphragm type control valves manufactured by Yamatake Honeywell were used for comparisons.

| | | |
|---|---|---|
| (1) Solution II flow rate variation | | |
| | Solution flow rate variation | |
| Invention: | ±0.5% or less | |
| Diaphragm Valve: | ±1.5% or less | |
| (2) Control potential variation | | |
| | $P_{Ag}$ variation range | |
| Invention: | 8.8 ± 0.05 or less | |
| Diaphragm Valve: | 8.8 ± 0.1 | |
| (3) Particle size and distribution | | |
| | Av. particle size | Standard Deviation |
| Invention: | 1.14 μm | 0.15 μm |
| Diaphragm Valve: | 1.12 μm | 0.35 μm |

With the photographic photosensitive solution manufacturing method and apparatus of the invention wherein flow control valves for controlling the flow rates of $Ag^+$ and $X^-$ solutions are controlled according to a predetermined flow rate or pAg potential program and using output signals of respective flow meters or a pAg potentiometer, and the flow control valves are motor-controlled flow control valves for which the rate of change of flow rate with valve stroke is small and linear, flow control in accordance with a program of the form $Q=at^2+bt+c$ can be carried out with a better response and smaller instantaneous variations than in the prior art. Furthermore, when carrying out flow control in accordance with a pAg potential program in the form of $E=lt^2+mt+c$, the pAg potential variation range can be made small, as a result of which the silver halide emulsion particles are sharp in size distribution and uniform in shape.

With the invention, the flow control valves are simple both in configuration and in construction, and can be applied to the production of a variety of photographic photosensitive solutions. Furthermore, the flow control valves are advantageous in that the times required for switching them or cleaning them are greatly reduced, and their flow control range is wide. As a result, the addition of $Ag^+$ and $X^-$ solutions can be achieved without significant residual loss.

What is claimed is:

1. A method for manufacturing photographic photosensitive solution, comprising the steps of:

preparing $Ag^+$ and $X^-$ solutions in advance;

supplying said $Ag^+$ and $X^-$ solutions to respective storage tanks;

providing for said storage tanks respective motor-controlled flow control valves having a rate of change of flow rate with valve stroke which is small as compared with diaphragm valves and linear;

positioning said flow control valves to supply first and second positions corresponding to predetermined initial flow rates of said $Ag^+$ and $X^-$ solutions, respectively;

initiating flow from said storage tanks; and controlling said flow control valves to supply $Ag^+$ and $X^-$ solution from said storage tanks to a precipitation vessel at rates determined in accordance with one of a predetermined flow rate program and a predetermined pAg potential program.

2. The method for manufacturing photographic photosensitive solution of claim 1, wherein said predetermined is a flow rate program is of the form $Q=at^2+bt+c$, where Q is flow rate, t is time, and a, b and c are constants.

3. The method for manufacturing photographic photosensitive solution of claim 2, further comprising the step of providing flow meters for measuring flow rates of said $Ag^+$ and $X^-$ solutions from said storage tanks into said precipitation vessel, and wherein said step of controlling said flow control valves comprises feedback controlling said flow control valves in accordance with output signals from said flow meters and said predetermined flow rate program.

4. The method for manufacturing photographic photosensitive solution of claim 1, wherein said predetermined pAg potential program is of the form $E=lt^2+mt+n$, where E is pAg potential in said precipitation vessel, t is time, and l, m and n are constants.

5. The method for manufacturing photographic photosensitive solution of claim 4, further comprising the step of providing a pAg potentiometer for measuring a pAg potential in said precipitation vessel, and wherein said step of controlling said flow control valves comprises feedback controlling said flow control valves in accordance with output signals from said pAg potentiometer and said predetermined pAg potential program.

* * * * *